US008159201B2

(12) United States Patent
Lin et al.

(10) Patent No.: US 8,159,201 B2
(45) Date of Patent: Apr. 17, 2012

(54) LINEAR REGULATOR AND VOLTAGE REGULATION METHOD

(75) Inventors: Ying-Hsi Lin, Hsinchu (TW); Tsung-Yen Tsai, Hsinchu (TW)

(73) Assignee: Realtek Semiconductor Corp., Hsinchu (TW)

( * ) Notice: Subject to any disclaimer, the term of this patent is extended or adjusted under 35 U.S.C. 154(b) by 557 days.

(21) Appl. No.: 12/321,509

(22) Filed: Jan. 22, 2009

(65) Prior Publication Data

US 2009/0189577 A1 Jul. 30, 2009

(30) Foreign Application Priority Data

Jan. 30, 2008 (TW) ..... 97103511 A

(51) Int. Cl.
*G05F 1/00* (2006.01)

(52) U.S. Cl. ..... 323/273; 323/269

(58) Field of Classification Search ..... 323/269, 323/270, 271, 272, 273, 274, 275, 276, 277
See application file for complete search history.

(56) References Cited

U.S. PATENT DOCUMENTS

| | | | | |
|---|---|---|---|---|
| 6,518,737 | B1 * | 2/2003 | Stanescu et al. | 323/280 |
| 7,218,084 | B2 | 5/2007 | Pons et al. | |
| 7,218,168 | B1 * | 5/2007 | Rahman | 327/540 |
| 2002/0171403 | A1 * | 11/2002 | Lopata | 323/280 |
| 2003/0085693 | A1 * | 5/2003 | Marty | 323/280 |
| 2007/0171403 | A1 | 7/2007 | Kasturi et al. | |

* cited by examiner

*Primary Examiner* — Adolf Berhane
*Assistant Examiner* — Nguyen Tran
(74) *Attorney, Agent, or Firm* — Thomas, Kayden, Horstemeyer & Risley, LLP

(57) ABSTRACT

The present invention discloses a linear regulator and a voltage regulation method. The method comprises: providing a power transistor for converting a supply voltage to an output voltage to a load according to the conduction condition of the power transistor; controlling the conduction condition of the power transistor according to a comparison between a feedback signal relating to the output voltage and a reference voltage; obtaining a signal relating to a load condition; and controlling the conduction capability of the power transistor according to the signal relating to the load condition.

16 Claims, 4 Drawing Sheets

LINEAR REGULATOR AND VOLTAGE REGULATION METHOD

BACKGROUND OF THE INVENTION

1. Field of the Invention

The present invention relates to a voltage regulator, and in particular to a linear regulator with fast response to the condition of a load.

2. Description of the Related Art

A typical example of linear regulators is the low drop-out (LDO) circuit. FIG. 1 shows a conventional LDO circuit 10, which includes a transconductor gm that controls a power transistor P0 to turn on or turn off according to a comparison between a feedback signal FB and a reference voltage Vref, so that a supply voltage Vcc Is converted to an output voltage Vout.

Such regulator has a drawback that it can not respond in time when its load changes from heavy to light or no load; its output is unstable under such circumstance, that is, the output overshoot will last a long time until it is relieved, and it will consume power unnecessarily.

In view of the above, a linear regulator with fast response to the condition of a load is desired.

SUMMARY OF THE INVENTION

A first objective of the present invention is to provide a linear regulator with fast response to the condition of a load.

A second objective of the present invention is to provide a voltage regulation method.

To achieve the foregoing objectives, in one aspect, the present invention discloses a linear regulator comprising: an adjustable power transistor having a first end coupled to a supply voltage, a second end coupled to an output voltage, and a third end for receiving a comparison signal; and a control circuit for generating a control signal to adjust a characteristic of the adjustable power transistor, wherein the adjustable power transistor is controlled by the comparison signal.

From another aspect, the present invention discloses a linear regulator comprising: a power transistor having a first end coupled to a supply voltage, and a second end coupled to an output voltage; a transconductor having an gain, which receives and compares a feedback signal relating to the output voltage with a reference voltage to generate a comparison signal to a third end of the power transistor; a clamp circuit coupled between the first end and the third end for control a voltage difference between the first end and the third end to avoid providing too much current to the second; and a control circuit for generating a control signal to adjust at least one of the gain of the transconductor and a characteristic of the power transistor according to the comparison signal.

From a further other aspect, the present invention discloses a voltage regulation method comprising: providing a power transistor to generate an output signal to a load according to the conduction condition of the power transistor; obtaining a control signal according to a load condition of the load; and controlling the conduction condition of the power transistor according to the control signal.

For better understanding the objects, characteristics, and effects of the present invention, the present invention will be described below in detail by illustrative embodiments with reference to the attached drawings.

DESCRIPTION OF THE PREFERRED EMBODIMENTS

Figure 1:
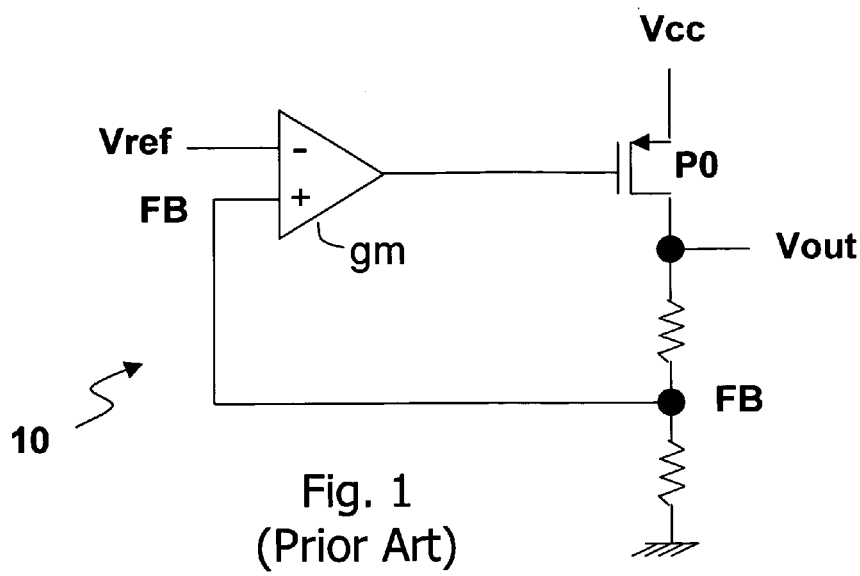
Fig. 1 (Prior Art)
FIG. 1 is a circuit diagram schematically showing a conventional LDO circuit.
Figure 2:
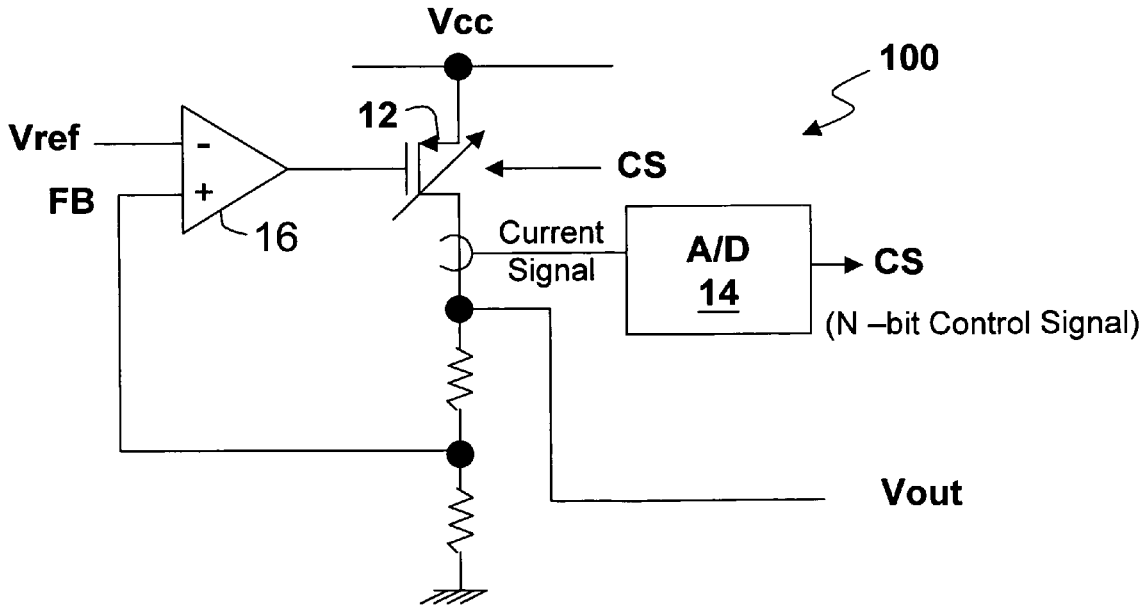
FIG. 2 is a circuit diagram schematically showing one embodiment of the present invention.

FIG. 2 schematically shows a first embodiment according to the present invention, in which an LDO circuit is shown as an example of linear regulators. As shown in the figure, the linear regulator 100 of the present invention includes a power transistor 12 having a variable size; its size is adjustable by a control signal CS. In the present invention, at least one characteristic of the power transistor 12 is adjustable. In this embodiment, the control signal CS is an N-bit digital signal generated by an analog-to-digital converter (ADC) 14 according to a voltage signal corresponding to the current signal flowing through the power transistor 12. It requires a large current due to the heavy load, thus, the control signal CS enlarge the size of the variable power transistor 12; when the load changes from heavy to light or no load, since the required current decreases, the control signal CS shrinks the size of the variable power transistor 12 to speed up its response time such that the circuit quickly enters a stable state, improving the efficiency of the circuit.

Figure 3:
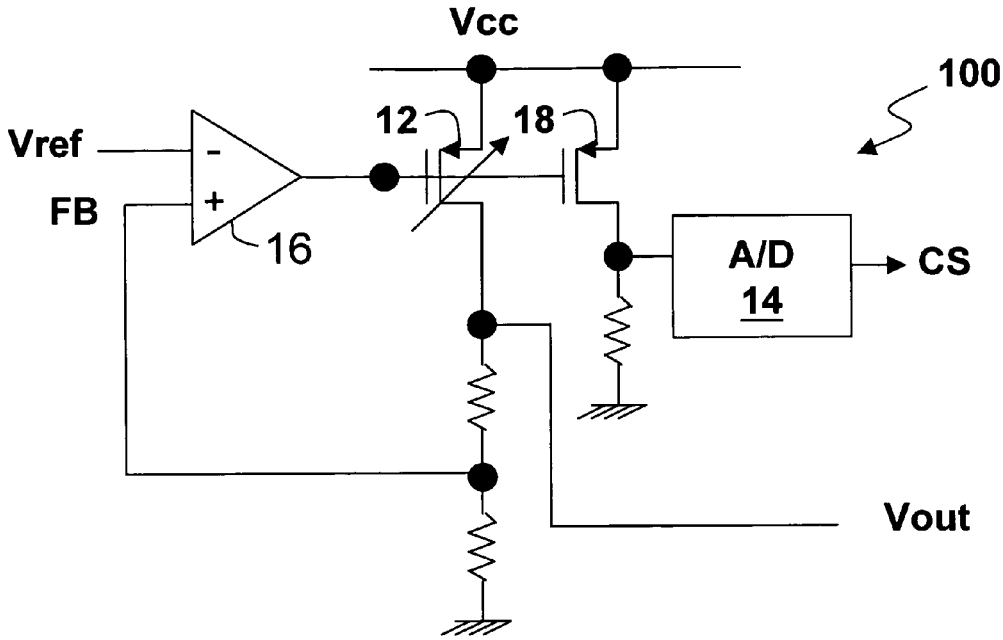
FIG. 3 shows an example to obtain the required current signal.

There are many ways to obtain the current signal, one of which is shown in FIG. 3 as an example. The current flowing through the power transistor 12 can be determined by the current flowing through the transistor 18 and the matching ratio between the transistor 12 and the transistor 18. Note that it is not required to know the exact current flowing through the power transistor 12; only a rough estimation is required to know the load condition, i.e., heavy or light load.

Figure 4:
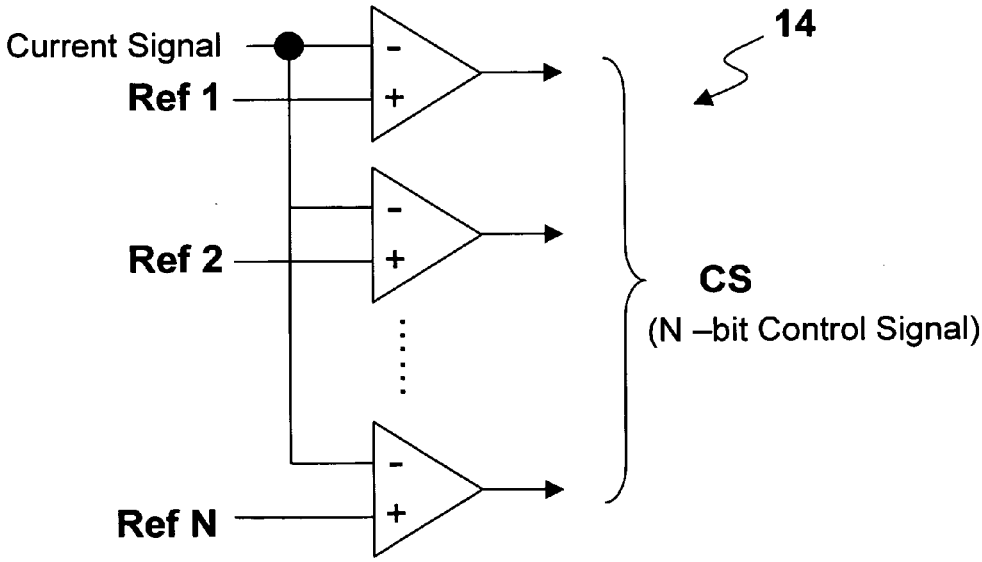
FIG. 4 shows an example of the analog-to-digital converter (ADC).

There are many ways to embody the ADC, one of which is shown in FIG. 4 as an example. The current signal (in the form of a voltage signal corresponding to the current flowing through the power transistor 12) is compared with multiple different reference voltages Ref 1 to Ref N, and an N-bit digital control signal CS is generated thereby. ADC is well known to those skilled in this art, so the details thereof are not further explained here for simplicity.

Figure 5:
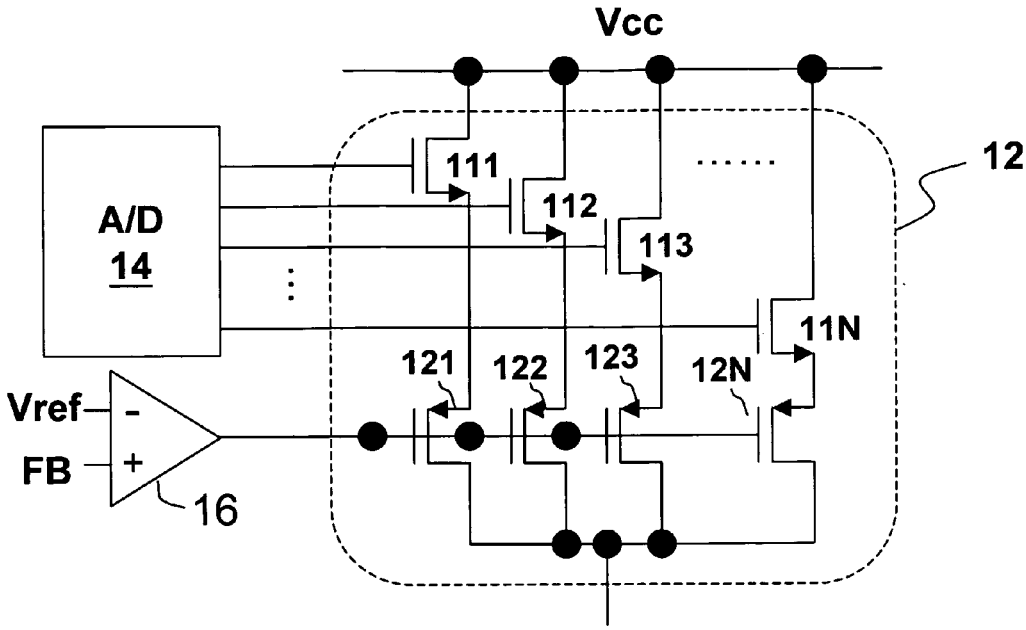
FIG. 5 shows an embodiment of the variable power transistor according to the present invention.

There are also many ways to adjust the size of the power transistor 12, one of which is shown in FIG. 5 as an example. As shown in the figure, the output of the transconductor 16 controls the gates of multiple power transistors 121-12N, and the sizes (gate widths) of these power transistors may be, e.g., 1:1:1:1 . . . , or 1:2:4:8 . . . , etc. The output of the ADC 14 (i.e., the N-bit digital control signal CS) determines whether each transistor is functioning. In this embodiment, when all of the output bits of the ADC 14 are high, the multiple power transistors 121-12N are all functioning; while when only some of the output bits of the ADC 14 are high, only the corresponding power transistors 121-12N are functioning. Thus, the size of power transistor 12 is adjustable.

Figure 6:
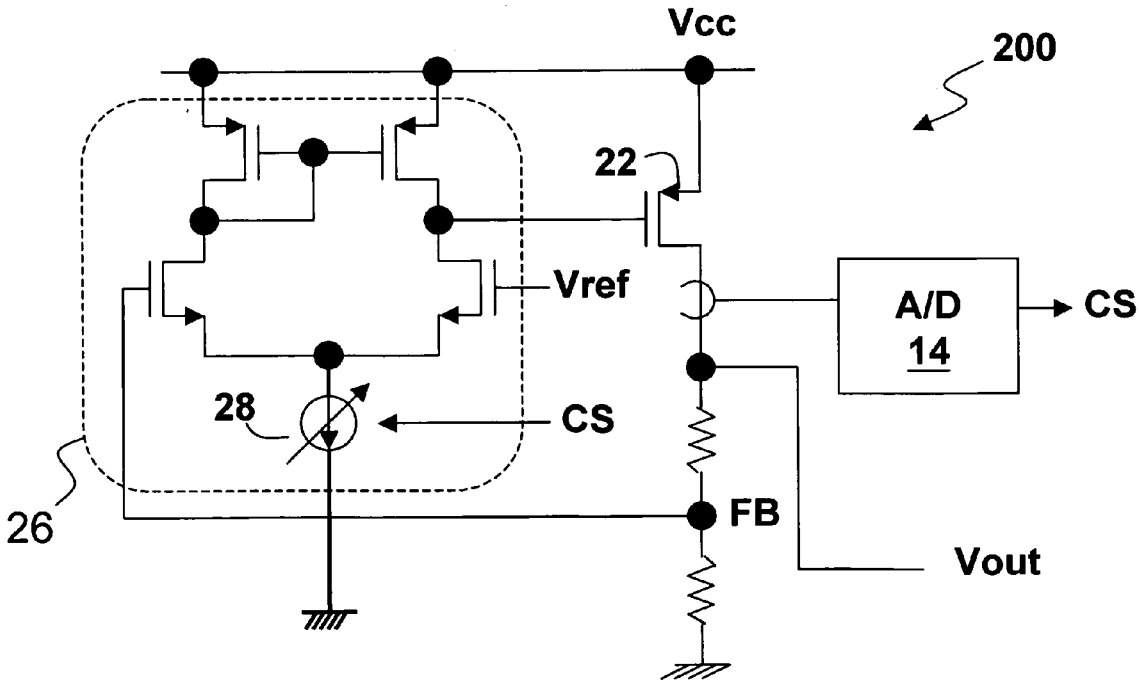
FIG. 6 is a circuit diagram schematically showing another embodiment according to the present invention.

FIG. 6 shows a linear regulator 200 according to another embodiment of the present invention. In this embodiment, the power transistor 22 is of a fixed size, but the gain of the transconductor 26 is adjustable by the control signal CS. As shown in the figure, the transconductor 26 includes a variable current source 28; by adjusting the current of the variable current source 28, the relationship between the feedback signal FB and the gate voltage of the power transistor 22 corresponding changes. When the load changes from heavy to light, the current flowing through the power transistor 22 in its ON state can be quickly reduced by decreasing the gain of the transconductor 26, so that the linear regulator quickly reaches a stable state.

Figure 7:
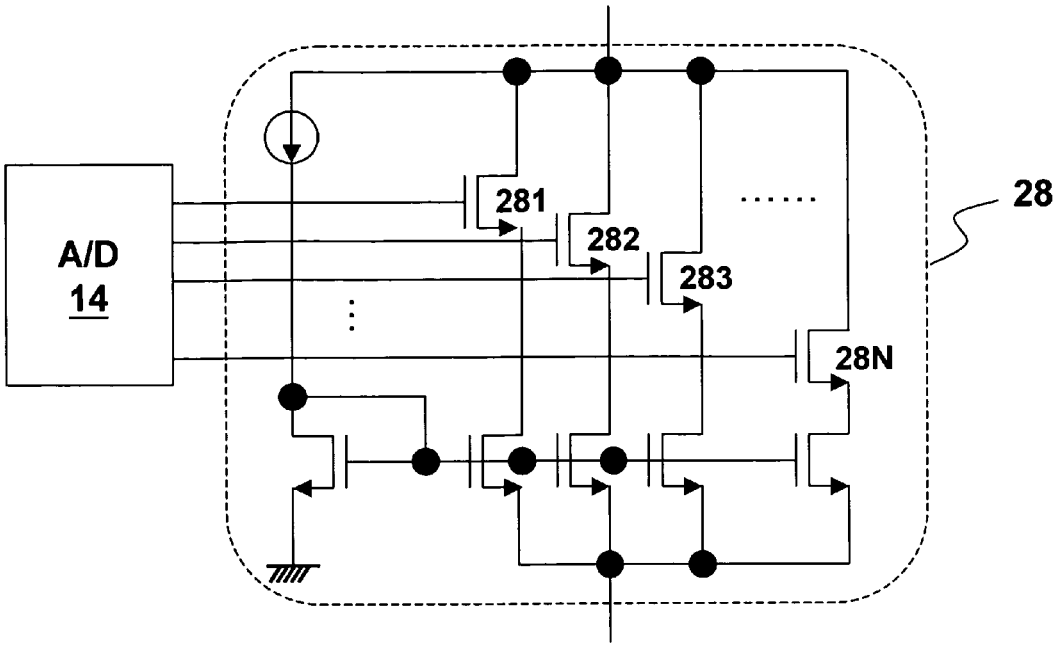
FIG. 7 shows an example of the variable current source.

There are also many ways to embody the variable current source 28, one of which is shown in FIG. 7 as an example. As shown in the figure, the variable current source 28 includes a current mirror which is controlled by the output of the ADC 14 to determine the total current. That is, when some of the output bits of the ADC 14 are high, only the corresponding switches 281-28N are ON to enable the corresponding paths to mirror the current. Thus, a variable current source with an adjustable total current is provided.

Figure 8:
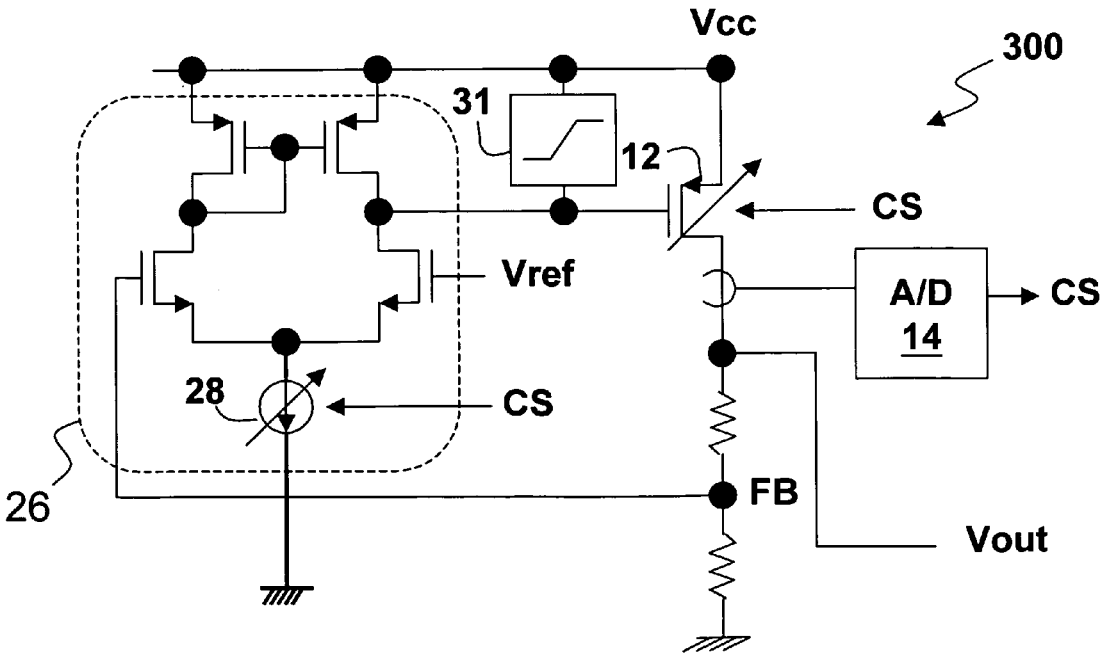
FIG. 8 is a circuit diagram schematically showing a further embodiment according to the present invention.

FIG. 8 shows a linear regulator 300 according to a further embodiment of the present invention. In this embodiment, both the size of the power transistor 12 and the gain of the transconductor 26 are adjustable. The size of the power transistor 12 and the gain of the transconductor 26 can be both controlled by the same control signal CS, or each controlled by different bits of the same control signal CS, or each controlled by a different control signal (the latter not shown; this can be embodied by, e.g., providing two ADCs performing analog-to-digital conversion according to different reference voltage levels).

Moreover, the circuit further includes a clamp circuit 31 to limit the gate-to-drain voltage difference Vgd of the power transistor 12 below a predetermined threshold, so as to avoid providing too much current to the output terminal, damaging a load circuit connected to the output terminal, that is to say, the clamp circuit 31 is such a circuit that provides a protection mechanism for the load circuit connected to the output terminal.

The features, characteristics and effects of the present invention have been described with reference to its preferred embodiments, for illustrating the spirit of the invention and not for limiting the scope of the invention. Various other substitutions and modifications will occur to those skilled in the art, without departing from the spirit of the present invention. For example, there are other locations to obtain the current signal than the one shown in FIG. 2; as an example, the current signal can be obtained from the output terminal. And, there are various ways to adjust the size of the power transistor 12 other than the one shown in FIG. 5, i.e., to adjust the size of the power transistor 12 by controlling the switches 111-11N. As an example, the output bits of the ADC 14 can be used to directly control the gates of the corresponding power transistors 121-12N, and omitting the switches 111-11N. Furthermore, it is only one of the preferred embodiments to control the size of the power transistor 12 by a digital signal after an analog-to-digital conversion. The size control can be done by other methods, which also belong to the scope of the present invention. Therefore, all such substitutions and modifications should be embraced within the scope of the invention as defined in the appended claims.

What is claimed is:

1. A linear regulator comprising:

an adjustable power transistor having a first end coupled to a supply voltage, a second end coupled to an output voltage, and a third end for receiving a comparison signal; and a control circuit for generating a control signal to adjust a characteristic of the adjustable power transistor, wherein the adjustable power transistor is controlled by the comparison signal; wherein the adjustable power transistor includes a plurality of transistors coupled in parallel, and wherein the characteristic of the adjustable power transistor is the sum of the channel width for each of the plurality of transistors with a turn-on current flowing through.

2. The linear regulator of claim 1, wherein the control circuit adjusts the characteristic of the adjustable power transistor according to one of a current flowing through the adjustable power transistor and an output current of the linear regulator.

3. The linear regulator of claim 1, wherein the control signal is digital.

4. The linear regulator of claim 3, wherein the control circuit includes an analog-to-digital converter.

5. The linear regulator of claim 1, further comprising a transconductor for comparing a feedback signal with a reference voltage to generate the comparison signal, wherein the feedback is relative to the output signal.

6. The linear regulator of claim 5, wherein the transconductor has an adjustable gain.

7. The linear regulator of claim 5, wherein the transconductor includes a variable current source whose current is controlled by the control signal.

8. A linear regulator comprising:

a power transistor having a first end coupled to a supply voltage, and a second end coupled to an output voltage, wherein the power transistor includes a plurality coupled in parallel;

a transconductor having a gain, which receives and compares a feedback signal relating to the output voltage with a reference voltage to generate a comparison signal to a third end of the power transistor;

a clamp circuit coupled between the first end and the third end or to control a voltage difference between the first end and the third end to avoid providing too much current to the second end; and a control circuit for generating a control signal to adjust at least one of the gain of the transconductor and a characteristic of the power transistor according to the comparison signal, wherein the characteristic of the power transistor is the sum of the channel width for each of the plurality of transistors with a turn-on current flowing through.

9. The linear regulator of claim 8, wherein the transconductor includes a variable current source whose current is controlled by the control signal.

10. The linear regulator of claim 8, wherein the control circuit adjusts the gain of the transconductor according to a load condition of the linear regulator.

11. The linear regulator of claim 8, wherein the control circuit includes an analog-to-digital converter, the control signal is digital, and the clamp circuit provides a protection mechanism for a load circuit coupled to the second end.

12. The linear regulator of claim 8, wherein the power transistor includes a plurality of transistors coupled in parallel.

13. A voltage regulation method comprising:

providing a power transistor to generate an output signal to a load according to a conduction condition of the power transistor, wherein the power transistor includes a plurality of transistors coupled in parallel;

obtaining a control signal according to a load condition of the load; and controlling the conduction condition of the power transistor according to the control signal, wherein the step of controlling the conduction condition of the power transistor according to the control signal is to adjust a characteristic of the power transistor according to the control signal, wherein the characteristic of the power transistor is the sum of the channel width for each of the plurality of transistors with a turn-on current flowing through.

14. The method of claim 13, wherein the step of obtaining the control signal relating to the load condition includes:

detecting a current flowing through the power transistor or a current supplied to the load.

15. The method of claim 13, further comprising the following steps:

providing a transconductor having a variable current source whose current is controlled by the control signal.

16. The method of claim 13, wherein the step of providing the power transistor to generate the output signal to the load comprises the following steps:

providing a transconductor for comparing a feedback signal relative to the output signal and a reference voltage to generate a comparison signal; and controlling the conduction condition of the power transistor according to the comparison signal.

* * * * *